US009845987B2

(12) United States Patent
Oturak et al.

(10) Patent No.: US 9,845,987 B2
(45) Date of Patent: Dec. 19, 2017

(54) COOLING DEVICE

(75) Inventors: Mehmet Oturak, Istanbul (TR); Emre Arisoy, Istanbul (TR); Veysi Ercan, Istanbul (TR); Ilkin Tacan, Istanbul (TR); Alper Mirza, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 1680 days.

(21) Appl. No.: 13/063,175

(22) PCT Filed: Sep. 8, 2009

(86) PCT No.: PCT/EP2009/061622
§ 371 (c)(1),
(2), (4) Date: Mar. 9, 2011

(87) PCT Pub. No.: WO2010/029068
PCT Pub. Date: Mar. 18, 2010

(65) Prior Publication Data

US 2011/0162399 A1 Jul. 7, 2011

(30) Foreign Application Priority Data

Sep. 9, 2008 (TR) ..... a 2008 06814

(51) Int. Cl.

| | |
|---|---|
| ***F25B 41/00*** | (2006.01) |
| ***G06F 17/00*** | (2006.01) |
| ***F25D 29/00*** | (2006.01) |
| ***F25D 11/02*** | (2006.01) |

(52) U.S. Cl.
CPC ..... *F25D 29/00* (2013.01); *F25D 11/02* (2013.01); *F25B 2400/22* (2013.01); *F25D 2400/36* (2013.01)

(58) Field of Classification Search
USPC ..... 62/196; 700/90
See application file for complete search history.

(56) References Cited

U.S. PATENT DOCUMENTS

| | | | | |
|---|---|---|---|---|
| 5,711,159 | A | 1/1998 | Whipple | |
| 6,321,548 | B1 * | 11/2001 | Clarke et al. | 62/222 |
| 6,397,606 | B1 * | 6/2002 | Roh et al. | 62/126 |
| 6,408,634 | B1 * | 6/2002 | Choi | 62/127 |
| 2001/0045096 | A1 * | 11/2001 | Tatter | 62/129 |
| 2002/0134096 | A1 * | 9/2002 | Shim et al. | 62/228.1 |
| 2003/0193240 | A1 * | 10/2003 | Lesesky et al. | 303/123 |
| 2004/0103674 | A1 * | 6/2004 | Boer et al. | 62/157 |
| 2007/0130968 | A1 * | 6/2007 | Kaga et al. | 62/157 |
| 2007/0157642 | A1 * | 7/2007 | Ferragut et al. | 62/139 |

(Continued)

FOREIGN PATENT DOCUMENTS

| | | |
|---|---|---|
| EP | 1245914 A2 | 10/2002 |
| EP | 1398584 A1 | 3/2004 |
| EP | 1942310 A2 | 7/2008 |

*Primary Examiner* — Henry Crenshaw
(74) *Attorney, Agent, or Firm* — Kilpatrick Townsend & Stockton LLP

(57) ABSTRACT

The present invention relates to a cooling device (1) comprising more than one cabinet (2, 102, 202) wherein items to be cooled are placed and which are positioned separately, a compressor (5) providing the cooling cycle to be performed, and more than one valve (6, 106, 206) providing the refrigerant pumped from the compressor (5) to be determined, to which cabinet (2, 102, 202) and in which amount it will be directed.

7 Claims, 1 Drawing Sheet

(56) References Cited

U.S. PATENT DOCUMENTS

| | | | | |
|---|---|---|---|---|
| 2007/0227204 | A1* | 10/2007 | Shoenfeld | 70/101 |
| 2008/0047287 | A1* | 2/2008 | Ruppert | 62/256 |
| 2008/0147212 | A1* | 6/2008 | Monma et al. | 700/90 |
| 2008/0156009 | A1* | 7/2008 | Cur et al. | 62/185 |
| 2013/0226320 | A1* | 8/2013 | Berg-Sonne et al. | 700/90 |

* cited by examiner

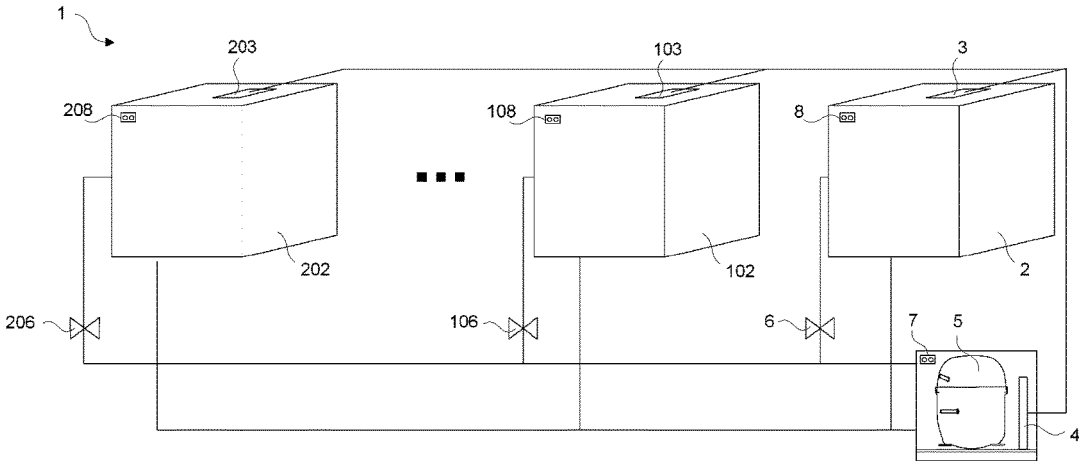
1
203
103
3
208
108
8
202
102
2
206
106
6
7
5
4

COOLING DEVICE

The present invention relates to a cooling device with a single compressor and multiple cabinets.

In cooling devices with a single compressor and multiple cabinets, the use of different cabinets different purposes such as crisper, wine rack, deep-freezer and hence providing different cooling conditions in different cabinets is needed. Various embodiments known in the state of the art are available that are related to the control of these systems with a single control card.

In the state of the art U.S. Pat. No. 6,408,634, European Patent No EP1398584 and U.S. Pat. No. 5,711,159 methods in cooling devices with a single compressor and multiple compartments are explained wherein compartments are provided to be kept in different cooling conditions by a single control card.

However, in these state of the art embodiments, the cooling conditions desired for the cabinets connected to the control card are similar for each cooling device and predetermined. For example, if there is a cabinet for crisper, a cabinet for wine rack and a deep-freezer in the cooling device, the type of each cabinet and the cooling conditions corresponding to these situations are saved in advance to the control card memory. Afterwards, the control card performs the cooling process according to these stored data. Yet, when the cabinets are separate and the option of buying a desired combination of different kinds of cabinets is desired to be offered to the user, performing the process by means of a single control card is not possible. A need arises for the usage of a cabinet card whereto the related cooling conditions are saved for each cabinet and of a main board providing the control of the compressor in order to enable the cabinets to be cooled under these conditions. This situation causes both an increase in the quantity of the stock and grouping and service errors.

The aim of the present invention is the realization of a cooling device wherein the inventory cost is reduced and ease of service is provided.

The cooling device comprises more than one cabinet positioned separately, a cabinet card located on each cabinet, having the feature of a dip switch that produces logic signal, a main board, in the memory of which a logic signal for each type of cabinet and a corresponding cooling algorithm is stored. The main board compares the logic signal, which is transmitted by the dip switch on the cabinet card according to its on/off sequence, with the data stored in its memory. As a result of the comparison, the main board applies the cooling algorithm stored in its memory, which corresponds to the said logic signal, for the related cabinet.

After each electricity failure, the main board updates the cabinet data by receiving the signal corresponding to the on/off positions of the switches from the cabinet cards.

In an embodiment of the present invention, the cooling device comprises a communication indicator indicating whether the communication between the cabinet cards and the main board is realized properly. The communication indicator is preferably a glowing indicator and comprises green and red LEDs. The communication indicator glows green if the communication between the cards can be realized properly and glows red if it cannot be realized properly, hence informs the user about the communication situation.

In an embodiment of the present invention, the cooling device comprises a cabinet indicator each, that are located on each cabinet and that indicate the communication situation between the cabinet cards and the main board. The cabinet indicator is preferably a glowing indicator and comprises green and red LEDs. The cabinet indicator glows green if the communication between the related cabinet card and the main board can be realized properly and glows red if it cannot be realized properly, hence informs the user about the communication situation of the said cabinet.

In the preferred embodiment of the present invention, if a cabinet card cannot communicate with the main board, the main board sets the cabinet to the safe mode by stopping the refrigerant transfer to this cabinet.

The process of bringing the switches on the cabinet cards to the on/off position such that they will produce a sequential logic signal suitable to the type of the cabinet is performed by assembly workers during the assembly or by service personnel during the service.

The model embodiments relating to a cooling device realized in order to attain the aim of the present invention are illustrated in the attached figures, where:

FIG. 1-is the schematic view of a cooling device.

The elements illustrated in the figures are numbered as follows:

1. Cooling device
2. 102. 202. Cabinet
3. 103. 203. Cabinet card
4. Main board
5. Compressor
6. 106. 206. Valve
7. Communication indicator
8. 108. 208. Cabinet indicator The cooling device (1) comprises more than one cabinet (2, 102, 202) wherein items to be cooled are placed and which are positioned separately, a compressor (5) positioned into a chamber separately from the cabinets (2, 102, 202) and providing the cooling cycle to be performed, and more than one valve (6, 106, 206) providing the detemination of to which cabinet (2, 102, 202) and in which amount the refrigerant pumped from the compressor (5) will be directed.

more than one valve (6, 106, 206) providing which cabinet (2, 102, 202) and in which amount the refrigerant pumped from the compressor (5) will be directed, The cooling device (1) furthermore comprises a cabinet card (3, 103, 203) located on each cabinet (2, 102, 202), having the feature of a dip switch and sending a sequential logic signal according to the on/off positions of the switches, a main board (4), in the memory of which a sequential logic signal for each type of cabinet (2, 102, 202) and a corresponding cooling algorithm is stored, and which detects the cooling algorithm that corresponds to the sequential logic signal coming from the cabinet card (3) according to the data stored in its memory and thus controls the compressor (5) and the valves (6, 106, 206) in accordance with these data When power is supplied to the cooling device (1), the cabinet card (3) transmits the sequential logic signal corresponding to the on/off positions of the switches thereon to the main board (4). The main board (4) receiving the signal compares this signal with the signals stored in its memory and detects the type of the cabinet (2) the signal is coming from. Then, the main board (4) applies the cooling algorithm matched with this signal in its memory to the said cabinet (2). The same process is performed for all cabinets (2, 102, 202) and the types of all cabinets (2, 102, 202) and hence the cooling algorithms to be applied are determined.

After each electricity failure, the main board (4) updates the cabinet (2, 102, 202) data by receiving the signal corresponding to the on/off positions of the switches from the cabinet cards (3, 103, 203).

In an embodiment of the present invention, the cooling device (1) comprises a communication indicator (7) indicating the communication situation between the cabinet cards (3, 103, 203) and the main board (4). The communication indicator (7) comprises preferably LEDs glowing green and red. When power is supplied to the cooling device (1), if the communication between the cabinet cards (3, 103, 203) and the main board (4) can be realized properly, the green LED in the communication indicator (7) glows. Thus, the information is transmitted to the user that the communication between the cabinet cards (3, 103, 203) and the main board (4) is realized without any problems. In the situation wherein the communication cannot be realized properly, the red LED in the communication indicator (7) glows. Thus, the information is transmitted to the user that there is a problem in the communication between the cabinet cards (3, 103, 203) and the main board (4).

In an embodiment of the present invention, the cooling device (1) comprises a cabinet indicator (8, 108, 208) each, that are located on each cabinet (2, 102, 202) and that indicate the communication situation between the cabinet cards (3, 103, 203) and the main board (4). The cabinet indicator (8, 108, 208) comprises preferably LEDs glowing green and red. When power is supplied to the cooling device (1), if the communication between the cabinet cards (3, 103, 203) and the main board (4) can be realized properly, the green LED in the cabinet indicator (8, 108, 208) glows. Thus, the information is transmitted to the user that the communication between the cabinet cards (3, 103, 203) and the main board (4) is realized without any problems. In the situation wherein the communication cannot be realized properly, the red LED in the cabinet indicator (8) belonging to the cabinet (2) that is not communicating glows. Thus, the information is transmitted to the user that there is a problem in the communication of the related cabinet (2).

In the preferred embodiment of the present invention, if a cabinet card (3) cannot communicate with the main board (4), the main board (4) sets this cabinet (2) to the safe mode. The valve (6) transferring refrigerant to this cabinet (2) is closed. Cooling continues in other cabinets (102, 202).

The process of bringing the switches on the cabinet cards (3, 103, 203) to the on/off position such that they will produce a sequential logic signal suitable to the type of the cabinet (2, 102, 202) is performed by the producer.

By means of the present invention, in the embodiments comprising a single compressor (5) providing the cooling cycle to be performed and more than one cabinet (2, 102, 202), the need of designing a separate control card for each type of cabinet (2, 102, 202) is eliminated and thus, the inventory cost is provided to be reduced and the production and assembly phases are facilitated.

It is to be understood that the present invention is not limited to the embodiments disclosed above and an expert in the technique can easily introduce different embodiments. These should be considered within the scope of the protection postulated by the claims of the present invention.

The invention claimed is:

1. A cooling device (1) comprising more than one cabinet (2, 102, 202) wherein items to be cooled are placed and which are positioned separately, a compressor (5) positioned into a chamber separately from the cabinets (2, 102, 202) and providing a cooling cycle to be performed, and more than one valve (6, 106, 206) providing a determination to which cabinet (2, 102, 202) and in which amount the refrigerant pumped from the compressor (5) will be directed, a cabinet card (3, 103, 203) located on each cabinet (2, 102, 202), wherein the cabinet card located on each cabinet includes a dip switch which sends a sequential logic signal according to an on/off positions of the dip switches, a main board (4), including storage of a memory of the sequential logic signal for each type of cabinet (2, 102, 202) and storage of a corresponding cooling algorithm, the main board adapted to detect the cooling algorithm that corresponds to the sequential logic signal coming from the cabinet card (3) according to the data stored in its memory, and the main board (4) adapted to apply the cooling algorithm stored in its memory corresponding to the logic signal related to each cabinet (2, 102, 202) and thus to control the compressor (5) and the more than one valve (6, 106, 206) in accordance with the cooling algorithm corresponding to the sequential logic signal coming from the cabinet card (3, 103, 203).

2. The cooling device as in claim 1, wherein the main board (4) receives the sequential logic signal corresponding to the on/off positions of the dip switches from each cabinet card (3, 103, 203) after each electricity failure and updates the cabinet data (2, 102, and 202) to the sequential logic signal corresponding to the on/off positions of the dip switches from each cabinet card (3, 103, 203) received.

3. The cooling device as in claim 1 or 2, further comprising a communication indicator (7) indicating whether there is communication between the cabinet cards (3, 103, 203) and the main board (4).

4. The cooling device (1) as in claim 3, wherein the communication indicator (7) comprises LEDs glowing green and red, wherein the green LED therein glows if the communication between the cabinet cards (3, 103, 203) and the main board (4) can be realized properly and wherein the red LED therein glows if the communication cannot be realized properly.

5. The cooling device (1) as in claim 1 or 2, further comprising a cabinet indicator (8, 108, 208) located on each cabinet (2, 102, 202) between the cabinet cards (3, 103, 203) and the main board (4).

6. The cooling device( 1) as in claim 5, wherein the cabinet indicator (8, 108, 208) comprises LEDs glowing green and red, wherein the green LED therein glows if the communication between the cabinet cards (3, 103, 203) and the main board (4) can be realized properly and wherein the red LED therein glows if the communication cannot be realized properly.

7. The cooling device (1) as in claim 1 or 2, wherein the main board (4) can set each cabinet (2) to a safe mode if the control card (3) related to the cabinet cannot communicate with the main board (4) by closing the valve (6) transferring refrigerant to the cabinet (2) having the cabinet card (3) which cannot communicate with the main board.

* * * * *